US008125413B2

(12) United States Patent
Kim

(10) Patent No.: US 8,125,413 B2
(45) Date of Patent: Feb. 28, 2012

(54) PLASMA DISPLAY DEVICE AND DRIVING METHOD THEREOF

(75) Inventor: Dong-Hyun Kim, Yongin (KR)

(73) Assignee: Samsung SDI Co., Ltd., Gongse-dong, Giheung-gu, Yongin-si, Gyeonggi-do (KR)

( * ) Notice: Subject to any disclaimer, the term of this patent is extended or adjusted under 35 U.S.C. 154(b) by 1097 days.

(21) Appl. No.: 11/984,305

(22) Filed: Nov. 15, 2007

(65) Prior Publication Data

US 2008/0129659 A1 Jun. 5, 2008

(30) Foreign Application Priority Data

Nov. 22, 2006 (KR) ..... 10-2006-0116049

(51) Int. Cl.
*G09G 3/28* (2006.01)

(52) U.S. Cl. ..... 345/67; 345/60

(58) Field of Classification Search ..... 345/60, 345/68, 67, 61, 62, 63, 64, 65, 66
See application file for complete search history.

(56) References Cited

U.S. PATENT DOCUMENTS

| | | | | |
|---|---|---|---|---|
| 2005/0140581 | A1* | 6/2005 | Kang et al. | 345/60 |
| 2006/0145959 | A1* | 7/2006 | Choi | 345/68 |
| 2006/0152447 | A1* | 7/2006 | Rhee | 345/67 |
| 2007/0063926 | A1* | 3/2007 | Jung et al. | 345/60 |

FOREIGN PATENT DOCUMENTS

| | | | | |
|---|---|---|---|---|
| JP | 2001228820 | A | * | 8/2001 |
| JP | 2001-341659 | A | | 12/2001 |
| KR | 2004-0038254 | A | | 5/2004 |
| KR | 10-2004-0057754 | | | 7/2004 |
| KR | 10-2005-0108436 | | | 11/2005 |
| KR | 10-2005-0113804 | | | 12/2005 |
| KR | 10-0573167 | | | 4/2006 |
| KR | 10-0573167 | B1 | * | 4/2006 |
| KR | 10-2006-0056157 | | | 5/2006 |

* cited by examiner

*Primary Examiner* — Quan-Zhen Wang
*Assistant Examiner* — Troy Dalrymple
(74) *Attorney, Agent, or Firm* — Robert E. Bushnell, Esq.

(57) ABSTRACT

A plasma display device and a method for driving the plasma display device capable of reducing noise. The plasma display device displays images using a plurality of discharge cells, and is constructed with a plurality of first electrodes, a plurality of second electrodes, and a plurality of third electrodes intersecting the first electrodes and second electrodes. The driving method of the plasma display device includes: initializing the plurality of discharge cells; selecting light-emission cells among the plurality of discharge cells; and discharging the light-emission cells by supplying the first electrodes of the light-emission cells with first sustain pulses whose periods are irregular and supplying the second electrodes with second sustain pulses whose periods are irregular and are alternative to the first sustain pulses. A rising period of a sustain pulse supplied to one of the first and second electrodes at least partially overlaps a falling period of a sustain pulse supplied to the other of the first and second electrodes.

10 Claims, 5 Drawing Sheets

PLASMA DISPLAY DEVICE AND DRIVING METHOD THEREOF

CLAIM OF PRIORITY

This application makes reference to, incorporates the same herein, and claims all benefits accruing under 35 U.S.C. §119 from an application for PLASMA DISPLAY AND DRIVING METHOD THEREOF earlier filed in the Korean Intellectual Property Office on 22 Nov. 2006 and there duly assigned Serial No. 10-2006-0116049.

BACKGROUND OF THE INVENTION

1. Field of the Invention

The present invention relates to a plasma display device and a method for driving the plasma display device, and more particularly, to a plasma display device and a method for driving the plasma display device, while minimizing generation of noise.

2. Description of the Related Art

A plasma display device employs a plasma display panel (PDP) to display letters, symbols or varying video images using plasma created by a gas discharge. For this purpose, a plasma display device is constructed with a plasma display panel displaying images and a plurality of driving circuit parts driving the visual display presented to an audience by the plasma display panel.

The plasma display panel of the plasma display device is driven by a frame of data signals. The frame can be divided into a plurality of sub-fields each having a weight value. Light emission cells and non-light emission cells are selected during an address period of each sub-field, and a sustain discharge is carried out in the light emission cells to display video images during a sustain period of each sub-field. And, a gray scale is represented by a combination of the weight values of the sub-fields during which a cell emits light.

The driving circuit part includes a number of switching elements such as semiconductor elements, e.g. FETs (Field Effect Transistors). These switching elements perform a lot of switching operations for a short time. These switching operations give rise to the vibration of the switching elements. The vibration arising from the switching elements either vibrates air or is transferred to other objects to vibrate air, and thus creates considerable noise.

Fourier transform (FFT) analysis shows that the frequency of the vibration transferred from the switching elements controlling sustain pulses among reset pulses, address pulses, and sustain pulses supplied to a plasma display panel is substantially identical to the frequency of the noise generated due to the vibration of the front panel and rear panel when a discharge occurs inside the plasma display panel. In this case, the frequency of vibration arising from the sustain pulses resonates at the frequency of the noise generated when the front panel and rear panel are vibrating. Accordingly, the amplitude of the undesirable noise increases greatly, which causes considerable noise.

In addition, during the sustain period, a number of sustain pulses are supplied to a plurality of sustain electrodes, and a number of sustain pulses are simultaneously supplied to a plurality of scan electrodes. At this time, the sustain pulses supplied to the sustain electrodes have the same frequency as the sustain pulses supplied to the scan electrodes. In this case, the amplitude of the vibration arising from the sustain pulses becomes greater because of the resonance between the sustain pulses supplied to both of the sustain electrodes and the scan electrodes, thus causing greater noise.

SUMMARY OF THE INVENTION

It is therefore an object of the present invention to provide an improve plasma display device and an improved method for driving the plasma display device.

It is another object to solve the above-mentioned problems occurring in the prior art.

It is still another object to provide a plasma display device and a method for driving the plasma display device, which can reduce noise.

According to an aspect of the present invention, there is provided a method for driving a plasma display device displaying images using a plurality of discharge cells. The plasma display device is constructed with a plurality of first electrodes, a plurality of second electrodes, and a plurality of third electrodes intersecting the first and second electrodes. The driving method includes: initializing the plurality of discharge cells; selecting light-emission cells among the plurality of discharge cells; and discharging the light-emission cells by supplying the first electrodes of the light-emission cells with first sustain pulses whose periods are irregular and supplying the second electrodes with second sustain pulses whose periods are irregular and are alternative to the first sustain pulses. A rising period of a sustain pulse supplied to one of the first and second electrodes at least partially overlaps a falling period of a sustain pulse supplied to the other of the first and second electrodes.

A maintaining period for maintaining a low level voltage of the first sustain pulse partially overlaps a maintaining period for maintaining a low level voltage of the second sustain pulse with a overlapped period identical to the overlapped period between the first sustain pulse supplied to the first electrode and the second sustain pulse supplied to the second electrode.

The overlapped period ranges from approximately 10 ns to approximately 500 ns.

According to another aspect of the present invention, there is provided a method for driving a plasma display device. The driving method includes: driving scan electrodes of a plasma display panel using a scan driver including a first energy recovery circuit and a first sustain pulse generator; and driving sustain electrodes of the plasma display panel using a sustain driver including a second energy recovery circuit and a second sustain pulse generator. The switching periods of a plurality of switching elements included in the scan driver and the sustain driver, respectively, are irregular. A period of time when a first switching element turned on to control a rising period of one of the first and second sustain pulses partially overlaps a period of time when a second switching element is turned on to control a falling period of the other of the first and second sustain pulses.

According to still another aspect of the present invention, there is provided a plasma display device constructed with: a plasma display panel; a scan driver driving scan electrodes of the plasma display panel, the scan driver including a first energy recovery circuit and a first sustain pulse generator generating a first sustain pulse whose period is irregular; and a sustain driver driving sustain electrodes of the plasma display panel, the sustain driver including a second energy recovery circuit and a second sustain pulse generator generating a second sustain pulse whose period is irregular. The switching periods of a plurality of switching elements included in the scan driver and the sustain driver, respectively, are irregular. A period of time when a first switching element is turned on to control a rising period of one of the first and second sustain pulses partially overlaps a period of time when a second switching element is turned on to control a falling period of the other of the first and second sustain pulses.

Each of the first and second energy recovery circuits is constructed with a recovery capacitor, a first switch connected to one end of the recovery capacitor to discharge the recovery capacitor, a second switch connected to one end of the recovery capacitor to charge the recovery capacitor, and a resonant inductor connected to a common node between the first and second switches.

A period of time when the second switch of the first energy recovery circuit is turned on partially overlaps a period of time when the first switch of the second energy recovery circuit is turned on.

A period of time when a switch is turned on to maintain a low level voltage of one of the first and second sustain pulses partially overlaps a period of time when another switch is turned on to maintain a low level voltage of the other of the first and second sustain pulses.

The first and second sustain pulse generators comprise a third switch connected to one end of the resonant inductor to apply a high level voltage of the sustain pulse and a fourth switch connected to the same end of the resonant inductor to apply a low level voltage of the sustain pulse.

A period of time when the fourth switch of the first sustain pulse is turned on partially overlaps a period of time when fourth switch of the second sustain pulse is turned on.

Further objects and advantages of the invention will be more fully understood from the following detailed description taken in conjunction with the accompanying drawings.

BRIEF DESCRIPTION OF THE DRAWINGS

A more complete appreciation of the invention and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Hereinafter, preferred embodiments of the present invention will be described in more detail with reference to FIGS. 1 to 5.

Figure 1:
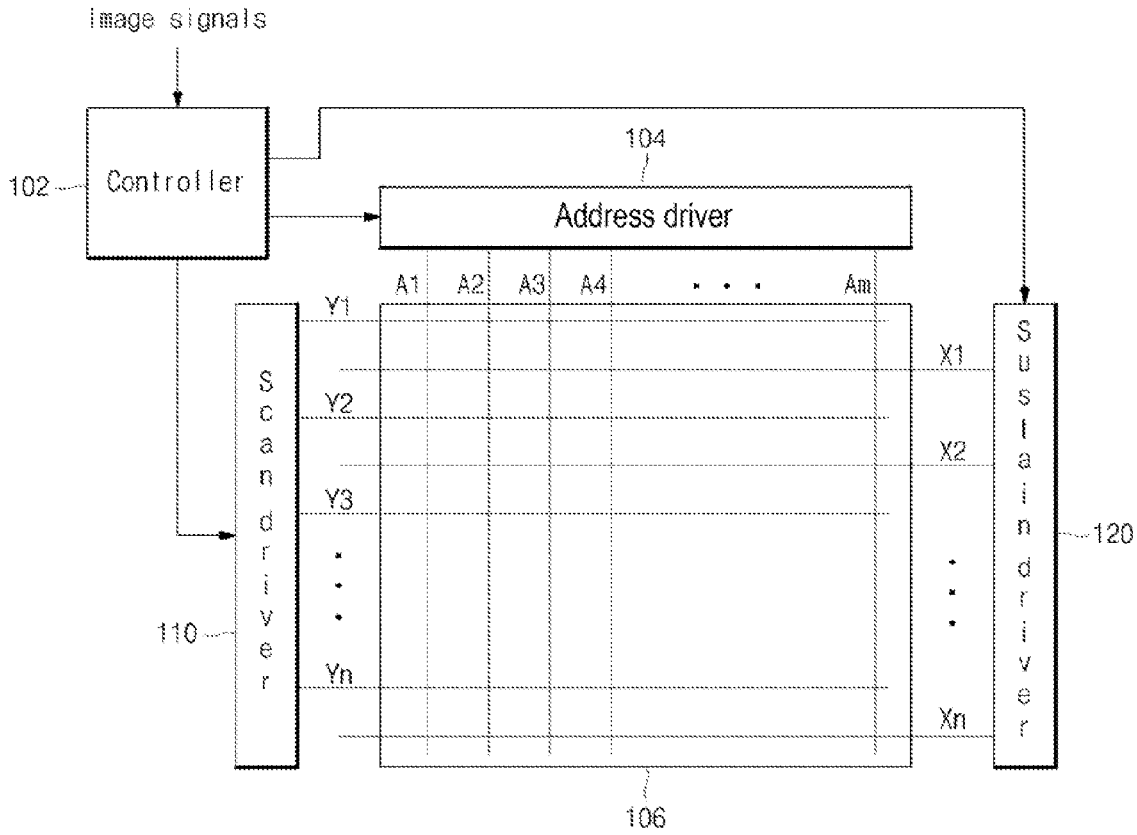
FIG. 1 is a block diagram illustrating a plasma display device constructed according to the principles of the present invention.

FIG. 1 is a block diagram illustrating a plasma display device according to the principles of the present invention.

Referring to FIG. 1, a plasma display device according to the principles of the present invention is constructed with a plasma display panel 106 displaying varying video images, an address driver 104 driving address electrodes (or referred to as the third electrodes) A1 to Am of plasma display panel 106, a scan driver 110 driving scan electrodes (or referred to as the first electrodes) Y1 to Yn, a sustain driver 120 driving sustain electrodes (or referred to as the second electrodes) X1 to Xn, and a controller 102 controlling drivers 104, 110 and 120.

Plasma display panel 106 displays video images by using a plurality of discharge cells (not shown) arranged in a matrix form. The discharge cells are defined by a plurality of address electrodes A1 to Am extended in a column direction, a plurality of scan electrodes Y1 to Yn extended in a row direction, and a plurality of sustain electrodes X1 to Xn extended in parallel with scan electrodes Y1 to Yn. Address electrodes A1 to Am are formed to intersect scan electrodes Y1 to Yn and sustain electrodes X1 to Xn.

Controller 102 controls address driver 104, scan driver 110 and sustain driver 120 by sending a frame of data signals. The frame is divided into a plurality of sub-fields, each of which consists of a reset period, an address period, and a sustain period in terms of period of time. Controller 102 receives vertical/horizontal synchronization signals and generates an address control signal, a scan control signal, and a sustain control signal for driving address driver 104, scan driver 110 and sustain driver 120, respectively. The generated control signals are supplied to the corresponding drivers 104, 110, 120, so that controller 102 may control drivers 104, 110, 120. In particular, controller 102 controls the ON and OFF of a plurality of switching elements included in scan driver 110 and sustain driver 120, both of which generate sustain pulses having irregular periods, supplied during the sustain period.

Address driver 104 supplies data signals to address electrodes A1 to Am to select discharge cells to be displayed in response to the address control signals supplied from controller 102.

Scan driver 110 applies driving voltages to scan electrodes Y1 to Yn in response to the scan control signals supplied from controller 102. In addition, scan driver 110 supplies sustain pulses having irregular periods to scan electrodes Y1 to Yn during the sustain period.

Sustain driver 120 applies driving voltages to sustain electrodes X1 to Xn in response to the sustain control signals supplied from controller 102. In addition, sustain driver 120 supplies sustain pulses having irregular periods to sustain electrodes X1 to Xn during the sustain period.

Figure 2:
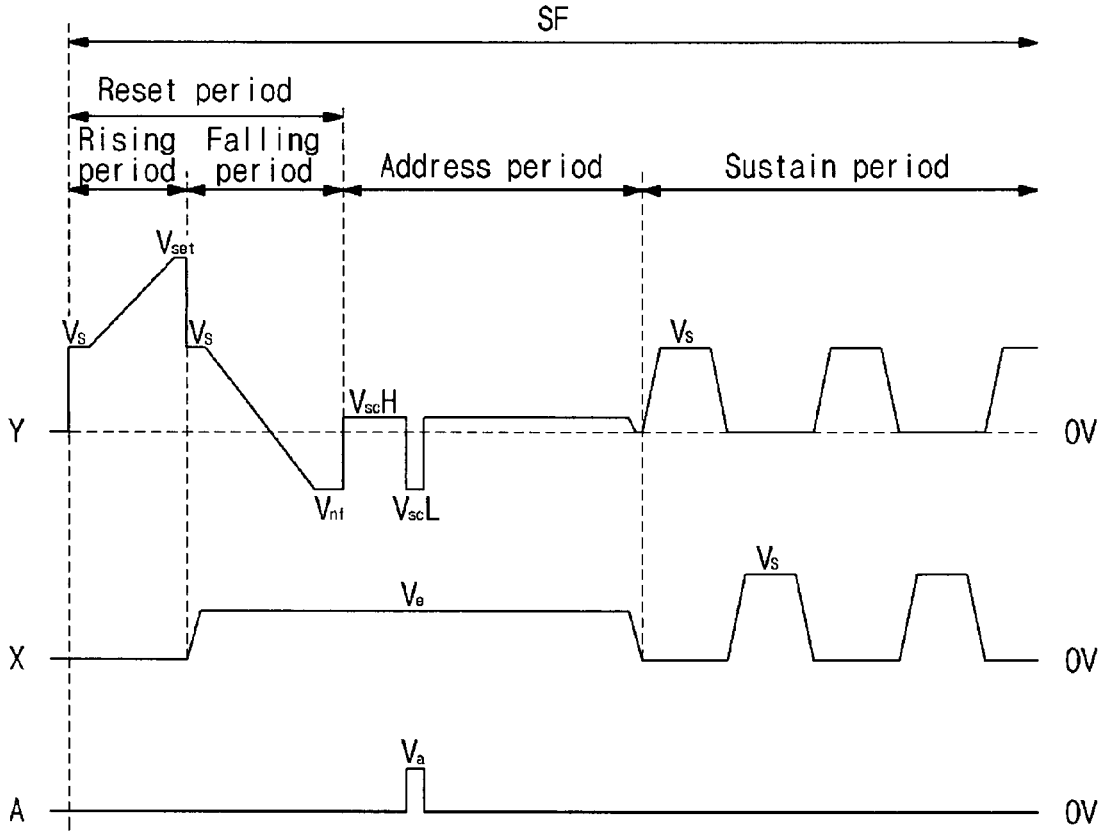
FIG. 2 is a diagram illustrating driving waveforms for the plasma display device shown in FIG. 1.

FIG. 2 is a view illustrating driving waveforms of a plasma display device according to the principles of the present invention.

Referring to FIG. 2, plasma display panel 106 displays video images by sequentially performing a reset function in a reset period, an address function in an address period, and a sustain function in a sustain period at basically one subfield (SF).

First, during a rising period of the reset period, a rising ramp pulse which rises gradually from Vs to Vset, is supplied to scan electrodes Y1 to Yn, while a reference voltage ('0 V' in FIG. 2) is kept to be supplied to sustain electrodes X1 to Xn. While the voltage supplied to scan electrodes Y1 to Yn increases, a weak discharge occurs between scan electrodes Y1 to Yn and sustain electrodes X1 to Xn and between scan electrodes Y1 to Yn and address electrodes A1 to Am. Therefore, negative wall charges are accumulated on scan electrodes Y1 to Yn and positive wall charges are accumulated on both sustain electrodes X1 to Xn and address electrodes A1 to Am.

Next, during a falling period of the reset period, a falling ramp pulse which falls gradually from Vs to Vnf, is supplied to scan electrodes Y1 to Yn, while a voltage Ve is constantly supplied to sustain electrodes X1 to Xn. While the voltage supplied to scan electrodes Y1 to Yn decreases, a weak reset discharge occurs between scan electrodes Y1 to Yn and sustain electrodes X1 to Xn and between scan electrodes Y1 to Yn and address electrodes A1 to Am. Therefore, the negative wall charges accumulated on scan electrodes Y1 to Yn and positive wall charges accumulated on both sustain electrodes X1 to Xn and address electrodes A1 to Am during the rising period of the reset period, are erased to thereby initialize the discharge cells. The magnitude of voltage |Vnf-Ve| is set to about a firing voltage required to initiate a discharge between scan electrodes Y1 to Yn and sustain electrodes X1 to Xn. Therefore, a wall voltage between scan electrodes Y1 to Yn and sustain electrodes X1 to Xn becomes about 0 V, and this prevents an undesirable discharge from occurring during the sustain period in the cells where an address discharge does not occur during the address period.

During the address period, a plurality of scan electrodes Y (Y1 to Yn) are sequentially applied with scan pulses each having a voltage VscL while voltage Ve is constantly supplied to a plurality of sustain electrodes X (X1 to Xn) in order to select discharge cells to be lit (i.e., light emission cells). At this time, a voltage Va is applied to a plurality of address electrodes A (A1 to Am) which pass through the discharge cells to be lit defined by the plurality of electrodes X applied with voltage Ve and electrodes Y applied with scan pulses with voltage VscL. Then, an address discharge occurs between electrodes A applied with voltage Va and electrodes Y applied with voltage VscL and between electrodes Y applied with voltage VscL and electrodes X applied with voltage Ve, to thereby accumulate positive wall charges on electrodes Y and negative wall charges on electrodes X and A, respectively. Voltage VscL may be set to be equal to or lower than voltage Vnf And, electrodes Y not applied with voltage VscL are applied with a voltage VscH which is higher than voltage VscL, and electrodes A passing through the discharge cells not selected (i.e., non-light emission cells) are applied with a reference voltage.

On the other hand, scan driver 110 selects electrodes Y among electrodes Y (Y1 to Yn) to be applied with scan pulses each having voltage VscL in order to perform addressing function during the address period. In a single driving operation, for example, scan driver 110 can select electrodes Y sequentially in the order of vertical direction. And, in the case that one electrode Y is selected, address driver 104 selects discharge cells to be lit among the discharge cells defined by the corresponding electrodes Y. That is, address driver 104 selects the cells to be lit by applying address pulses with voltage Va to the corresponding electrodes A among electrodes A (A1 to Am).

During the sustain period, electrodes Y and electrodes X corresponding to the discharge cells to be lit are applied alternately with sustain pulses having a high level voltage (Vs in FIG. 2) and a low level voltage ('0 V' in FIG. 2) whose periods are irregular, and a sustain discharge occurs between electrodes Y and electrodes X corresponding to the discharge cells to be lit.

Figure 3:
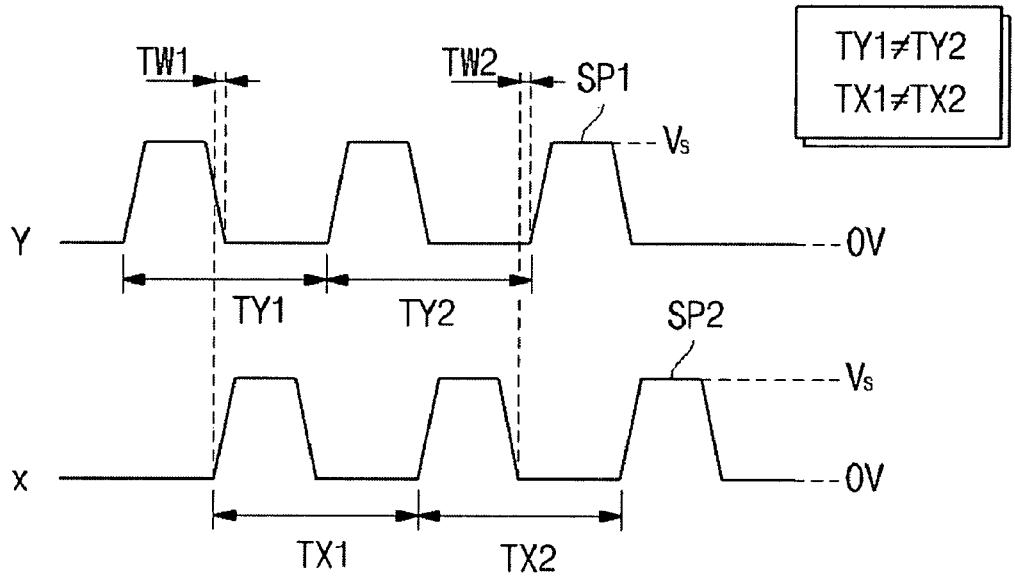
FIG. 3 is a waveform diagram particularly illustrating sustain pulses supplied during a sustain period shown in FIG. 2.

Specifically, as shown in FIG. 3, a first sustain pulse SP1 having alternating high level voltage Vs and low level voltage 0 V is supplied to electrodes Y and a second sustain pulse SP2 having an opposite phase to first sustain pulse SP1 is supplied to electrodes X during the sustain period. A falling period of the first sustain pulse SP1, which falls from high level voltage Vs to the low level voltage 0 V, partially overlaps a rising period of second sustain pulse SP2, which rises from the low level voltage 0 V to high level voltage Vs, and thus resulting in a first overlapped period TW1. In the present embodiment, first overlapped period TW1 is approximately 10 ns to approximately 500 ns. The present invention, however, is not limited thereto. The lapse of first overlapped period TW1 can be varied depending on the property of panel. And, the falling period of first sustain pulse SP1 does not overlap the period during which high level voltage Vs is applied to electrodes X at second sustain pulse SP2. In addition, a part of first sustain pulse SP1 maintaining a low level voltage of 0 V overlaps a part of second sustain pulse SP2 maintaining a low level voltage of 0 V, and thus resulting in a second overlapped period TW2 to compensate the sustain period that is reduced due to overlapped period TW1 while first and second sustain pulses SP1, SP2 overlap each other for at least one time.

During the sustain period, first sustain pulse SP1 which has the high level voltage Vs and the low level voltage of 0 V is applied to the electrode Y, and second sustain pulse SP2 which has the opposite phase compared to first sustain pulse SP1 is applied to the electrode X. Generally, in the plasma display device, the periods of the first and second sustain pulses are the same. In this way, the total frequency of the first and second sustain pulses having the regular period is identical with the frequency of the noise generated by the resonance of the front and rear panels. If the total frequency of the first and second sustain pulse is identical with the frequency of the noise, the total frequency amplitude of the first and second sustain pulse is added to the noise frequency amplitude, and the noise may be louder.

To prevent this loud noise, the total frequency of the first and second sustain pulses is controlled so as to be different than the noise frequency, because the added noise frequency amplitude is offset in a portion of the frequency when the total frequency of the first and second sustain pulses is added to the noise frequency. In this way, some parts of the noise frequency amplitude to which the total frequency of the first and second sustain pulse is added, is reduced.

In the present invention, the falling period of the first sustain pulse is provided to partially overlap the rising period of the second sustain pulse. Therefore, the total frequency of the first and second sustain pulses is provided to be different from the noise frequency.

Therefore, it can be possible to maximally suppress resonance between first and second sustain pulses SP1, SP2 because each period TY, TX of first and second sustain pulses SP1, SP2, respectively, is irregular. In addition, the frequency of the noise generated due to the vibration of the front and rear panels of the plasma display device during the discharge, becomes different from the frequency of the vibration generated by the switching elements performing switching operations to generate first and second sustain pulses SP1, SP2 and which is transferred to the plasma display panel. The plasma display device according to the principles of the present invention can minimize noise because the plasma display device is capable of preventing the noise amplitude from increasing by altering the vibration frequency to be non-identical to the noise frequency.

Figure 4:
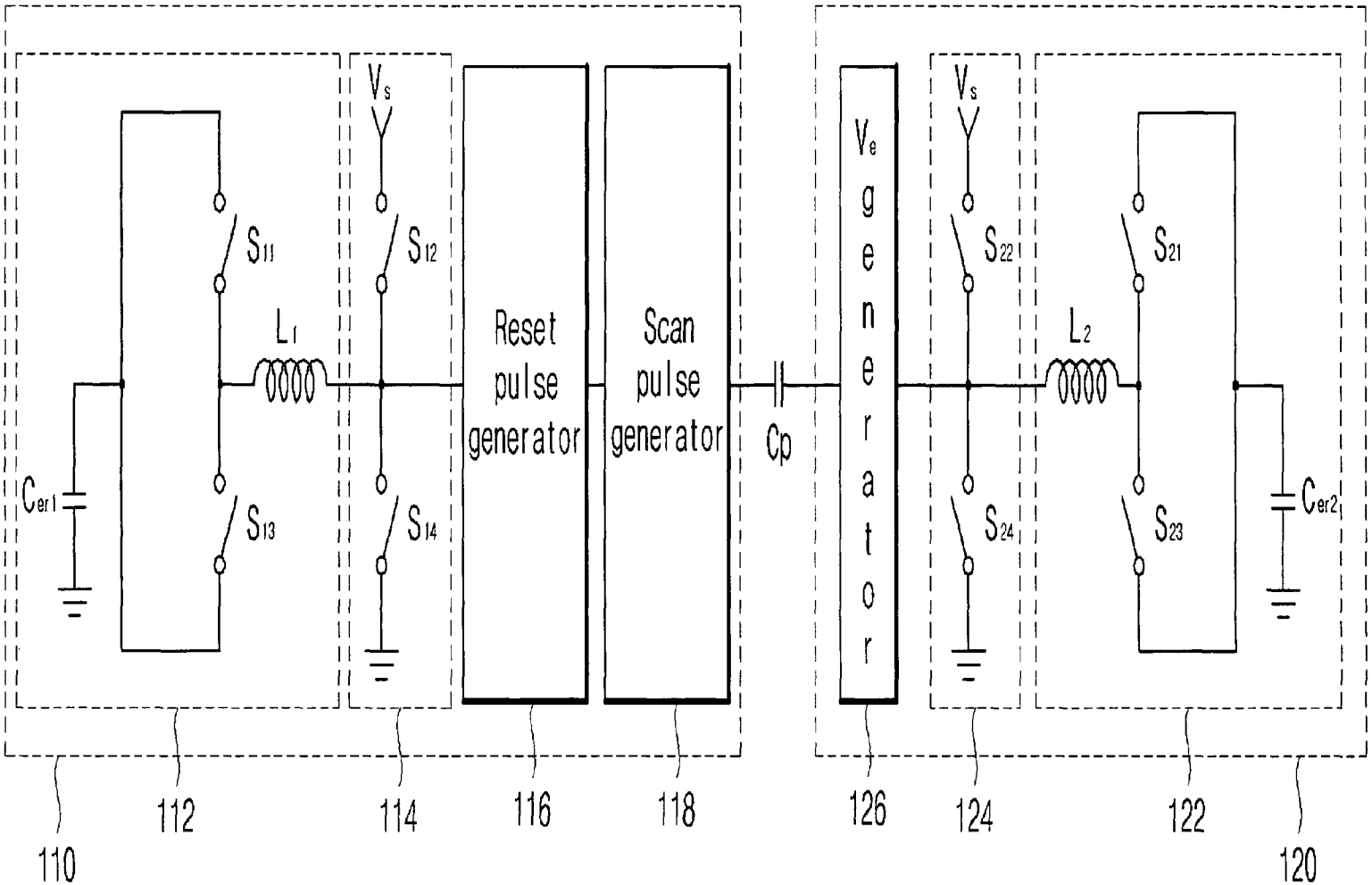
FIG. 4 is a diagram illustrating a driver for generating a first and a second sustain pulses according to the principles of the present invention.

FIG. 4 is a view illustrating in more detail the scan driver and sustain driver for generating sustain pulses shown in FIGS. 2 and 3. It should be noted that an energy recovery circuit of FIG. 4 is briefly illustrated to help the understanding of the present invention, but is not limited to thereto.

A scan driver 110 is constructed with a scan energy recovery circuit (or referred to as the first energy recovery circuit) 112, a reset pulse generator 116, a scan pulse generator 118, and a first sustain pulse generator 114. A sustain driver 120 is constructed with a sustain energy recovery circuit (or referred to as the second energy recovery circuit) 122, a second sustain pulse generator 124, and a Ve generator 126.

Reset pulse generator 116 supplies scan electrodes Y with the rising ramp pulse and falling ramp pulse during the reset period shown in FIG. 2. Scan pulse generator 118 supplies scan electrodes Y with the scan pulse during the address period shown in FIG. 2. Ve generator 126 supplies a voltage Ve to sustain electrodes X during the address period and falling period of the reset period shown in FIG. 2. First sustain pulse generator 114 supplies high level voltage Vs and low level voltage 0 V to scan electrodes Y during the sustain period, and second sustain pulse generator 124 supplies high level voltage Vs and low level voltage 0 V to sustain electrodes X during the sustain period. These circuits are well known by those skilled in the art, and thus the detailed circuit constructions and operations will now be omitted.

Scan energy recovery circuit 112 is constructed with a recovery capacitor Cer1 for recovering reactive power from a panel capacitor Cp and switches S11, S13 each connected to one end of recovery capacitor Cer1. In addition, one end of a resonant inductor L1 is connected to switches S1, S13, and the other end is connected to switches S12, S14 of first sustain pulse generator 114.

Sustain energy recovery circuit 122 is constructed with a recovery capacitor Cer2 for recovering reactive power from panel capacitor Cp and switches S21, S23 each connected to one end of recovery capacitor Cer2. In addition, one end of a resonant inductor L2 is connected to switches S21, S23, and the other end is connected to switches S22, S24 of second sustain pulse generator 124.

Figure 5:
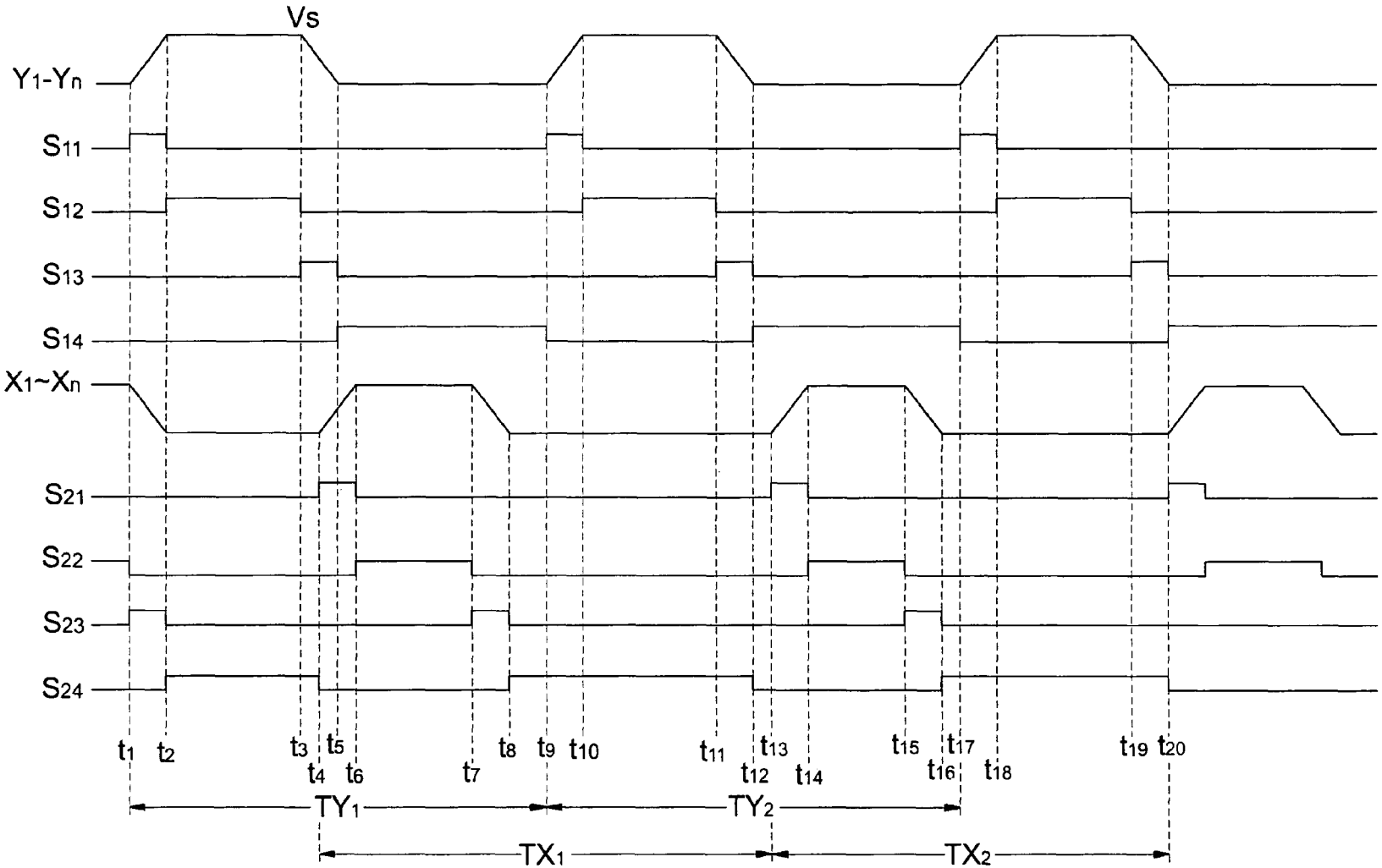
FIG. 5 is a diagram illustrating ON/OFF timing of the switching elements shown in FIG. 4.

FIG. 5 shows waveforms of sustain pulses supplied to each of the scan electrodes and sustain electrodes in a method for driving a plasma display device according to the principles of the present invention. A more detailed description will be now discussed in conjunction with FIG. 4.

First, when scan energy recovery circuit 112 turns on switch S11, inductor L1 and capacitor Cer1 resonate by the voltage charged to recovery capacitor Cer1, and the voltage of the sustain pulse rises to high level voltage Vs of the sustain voltage (during time periods t1 to t2, t9 to t10, t17 to t18). In this state, when switch S11 is turned off and simultaneously switch S12 connected to a Vs voltage source is turned on, the voltage of the sustain pulse is maintained at high level voltage Vs (during time periods t2 to t3, t10 to t11, t18 to t19). Subsequently, when switch S12 is turned off and simultaneously switch S13 connected to recovery capacitor Cer1 is turned on, inductor L1 and capacitor Cer1 resonates and the voltage of the sustain pulse falls from high level voltage Vs to low level voltage 0 V, i.e. ground voltage, and electric charges previously charged in panel capacitor Cp are moved to recovery capacitor Cer1 to thereby charge recovery capacitor Cer1 (during time periods t3 to t5, t11 to t12, t19 to t20). In this state, when switch S13 is turned off and simultaneously switch S14 connected to the ground voltage source is turned on, the voltage of the sustain pulse supplied to panel capacitor Cp falls to the low level voltage 0 V, i.e. ground voltage, and the voltage of the sustain pulse is maintained at the low level voltage 0 V (during time periods t5 to t9, t12 to t16).

On the other hand, when sustain energy recovery circuit 122 turns on switch S23 connected to recovery capacitor Cer2, inductor L2 and capacitor Cer2 resonate and the voltage of the sustain pulse falls from high level voltage Vs to the ground voltage (during time periods t1 to t2, t7 to t8, t15 to t16). In this state, when switch S23 is turned off and simultaneously switch S24 connected to the ground voltage source is turned on, the voltage of the sustain pulse supplied to panel capacitor Cp is maintained at the ground voltage (during time periods t2 to t4, t8 to t13, t16 to t20). Subsequently, when switch S24 is turned off and simultaneously switch S21 is turned on, then inductor L2 and panel capacitor Cp resonate by the voltage charged to recovery capacitor Cer2 and the voltage of the sustain pulse rises to high level voltage Vs (during time periods t4 to t6, t13 to t14). In this state, when switch S21 is turned off and simultaneously switch S22 connected to Vs voltage source is turned on, the voltage of the sustain pulse is kept to high level voltage Vs (during time periods t6 to t7, t14 to t5).

As shown in FIG. 5, switch S13 of scan energy recovery circuit 112 in scan driver 110 is turned on from time t3 to time t5, and switch S21 of sustain energy recovery circuit 122 in sustain driver 120 is turned on from time t4 to time t6. The time period from t3 to t5 partially overlaps the time period from t4 to t6, resulting in a overlapped period from t4 to t5. The overlapped period is approximately 10 ns to approximately 500 ns.

Similarly, switch S14 of first sustain pulse generator 114 in scan driver 110 is turned on from time t5 to time t9, and switch S24 of second sustain pulse generator 124 in sustain driver 120 is turned on from time t8 to time t12. The time period from t5 to t9 partially overlaps the time period from t8 to t12, resulting in a overlapped period from t8 to t9.

In the present invention as describe above, in each pair of switches S11 and S23, switches S12 and S24, switches S13 and S21, and switches S14 and S22, the switching periods are not identical to each other. In comparison, in the prior art, the above switching periods are identical to each other.

Therefore, since the switching periods are not identical to each other, the frequency of vibration transferred to the plasma display panel by the switching elements becomes different from the noise frequency generated due to the vibration of the front and rear panels of the plasma display device during the discharge. The increase of vibration can be prevented because the vibration frequency is not identical to the noise frequency, which can minimize noise.

As described above, the plasma display device according to the principles of the present invention can minimize noise since the first sustain pulse supplied to the scan electrodes and the second sustain pulse supplied to the sustain electrodes have irregular periods and a rising period of one of the first and second sustain pulses partially overlaps a falling period of the other of the first and second sustain pulses.

The foregoing exemplary embodiments and aspects of the invention are merely exemplary and are not to be construed as limiting the present invention. The present teaching can be readily applied to other types of devices. Also, the description of the exemplary embodiments of the present invention is intended to be illustrative, and not to limit the scope of the claims, and many alternatives, modifications, and variations will be apparent to those skilled in the art.

What is claimed is:

1. A method for driving a plasma display device displaying varying video images using a plurality of discharge cells defined by a plurality of first electrodes, a plurality of second electrodes, and a plurality of third electrodes intersecting the first and second electrodes, comprising:

initializing the plurality of discharge cells;

selecting light-emission cells from among the plurality of discharge cells; and discharging the light-emission cells by supplying the first electrodes corresponding to the light-emission cells with first sustain pulses whose periods are irregular and supplying the second electrodes with second sustain pulses whose periods are irregular and which are alternative to the first sustain pulses, with at least one pair of the first sustain pulses having different periods, and at least one pair of the second sustain pulses having different periods, with a rising period of a sustain pulse supplied to one of the first and second electrodes at least partially overlapping a falling period of a sustain pulse supplied to the other one of the first and second electrodes, with a maintaining period for maintaining a low level voltage of the first sustain pulse partially overlapping a maintaining period for maintaining a low level voltage of the second sustain pulse, and with the overlapped period being equal to the overlapped period between the rising period of the sustain pulse supplied to one of the first and second electrodes and the falling period of the sustain pulse being supplied to the other one of the first and second electrodes.

2. The driving method of claim 1, with the overlapped period ranging from approximately 10 ns to approximately 500 ns.

3. A method for driving a plasma display device, comprising:

driving scan electrodes of a plasma display panel using a scan driver comprising a first energy recovery circuit and a first sustain pulse generator, and supplying the scan electrodes with first sustain pulses, with at least one pair of neighboring first sustain pulses having different periods; and driving sustain electrodes of the plasma display panel using a sustain driver comprising a second energy recovery circuit and a second sustain pulse generator, and supplying the sustain electrodes with second sustain pulses, with at least one pair of neighboring second sustain pulses having different periods, with the switching periods of a plurality of switching elements included in the scan driver and the sustain driver, respectively, being irregular, and with a period of time when the switching elements are turned on to control a rising period of one of the first and second sustain pulses partially overlapping a period of time when the switching elements are turning on to control a falling period of the other of the first and second sustain pulses, with a first maintaining period for maintaining a low level voltage of one of the first and second sustain pulses partially overlapping a second maintaining period for maintaining a low level voltage of the other of the first and second sustain pulses.

4. The driving method of claim 3, with the overlapped period ranging from approximately 10 ns to approximately 500 ns.

5. A plasma display device, comprising:

a plasma display panel;

a scan driver driving a plurality of scan electrodes of the plasma display panel, the scan driver comprising:

a first energy recovery circuit; and a first sustain pulse generator generating first sustain pulses whose periods are irregular, with at least one pair of the first sustain pulses having different periods; and a sustain driver driving a plurality of sustain electrodes of the plasma display panel, the sustain driver comprising:

a second energy recovery circuit; and a second sustain pulse generator generating second sustain pulse pulses whose period is periods are irregular, with at least one pair of the second sustain pulses having different periods, with the switching periods of a plurality of switching elements included in the scan driver and the sustain driver, respectively, being irregular, and with a rising period of one of the first and second sustain pulses partially overlapping a falling period of the other of the first and second sustain pulses, with the period of time when a switch for maintaining a low level voltage of one of the first and second sustain pulses is turned on partially overlapping the period of time when another switch for maintaining a low level voltage of the other of the first and second sustain pulses is turned on.

6. The plasma display device of claim 5, with each of the first and second energy recovery circuits comprising:

a recovery capacitor;

a first switch connected to the recovery capacitor to discharge the recovery capacitor;

a second switch connected to the recovery capacitor to charge the recovery capacitor; and a resonant inductor connected to a common node between the first and second switches.

7. The plasma display device of claim 6, with the period of time when the second switch of the first energy recovery circuit is turned-on partially overlapping the period of time when the first switch of the second energy recovery circuit is turned-on.

8. The plasma display device of claim 6, with the period of time when the first switch of the first energy recovery circuit is turned-on partially overlapping the period of time when the second switch of the second energy recovery circuit is turned-on.

9. The plasma display device of claim 6, with each of the first and second sustain pulse generators comprising:

a third switch connected to one end of the resonant inductor to apply a high level voltage of the sustain pulse; and a fourth switch connected to one end of the resonant inductor to apply a low level voltage of the sustain pulse.

10. The plasma display device of claim 9, with the period of time when the fourth switch of the first sustain pulse is turned on partially overlapping the period of time when the fourth switch of the second sustain pulse is turned on.

* * * * *